United States Patent [19]

Steingass

[11] Patent Number: 4,944,460

[45] Date of Patent: Jul. 31, 1990

[54] MULTIFUNCTION NOZZLE

[75] Inventor: Robert W. Steingass, Valparaiso, Ind.

[73] Assignee: Task Force Tips, Inc., Valparaiso, Ind.

[21] Appl. No.: 243,283

[22] Filed: Sep. 9, 1988

[51] Int. Cl.[5] ..... A62C 33/00; B05B 1/26

[52] U.S. Cl. ..... 239/428.5; 239/439; 239/507; 169/89

[58] Field of Search ..... 239/438–442, 239/456–458, 460, 499, 505, 507, 514, 343, 428.5, 515; 169/89

[56] References Cited

U.S. PATENT DOCUMENTS

| | | | |
|---|---|---|---|
| 943,780 | 12/1909 | Hughes | 239/494 |
| 2,552,445 | 5/1961 | Nielsen | 239/499 |
| 3,363,842 | 1/1968 | Burns | 239/441 |
| 4,176,794 | 12/1979 | Allenbaugh | 239/458 X |
| 4,497,442 | 2/1985 | Williams | 239/437 |
| 4,640,461 | 2/1987 | Williams | 239/317 |
| 4,646,973 | 3/1987 | Focaracci | 239/343 X |
| 4,653,693 | 3/1987 | Steingass | 239/456 X |
| 4,669,665 | 6/1987 | Shay | 239/428.5 |

FOREIGN PATENT DOCUMENTS

| | | | |
|---|---|---|---|
| 398708 | 9/1933 | United Kingdom | 239/456 |

OTHER PUBLICATIONS

A publication of National Foam titled "Portable Aer-O-Foam Nozzles" (Revised) (11-86).

A publication of Akron Brass, catalog No. 106, p. 39, on Foam Nozzles & Foam Generator (no date).

A publication of Elkhart titled "Fire Fighting Equipment", catalog-T, pp. 20 and 21 on Foam Nozzles (no date).

A publication of Halprin Supply Company Describing Foam Equipment by Macron Fire Ltd. (No date).

A publication titled "Angus Foammasters" (no date).

A publication of National Foam titled "Foam Liquids and Equipment for Municipal and Volunteer Fire Departments", pp, 1-16 (copyright 1980).

A publication of Chemonics Industries, Inc. titled "Use Guidelines for Fire-Trol Firefoam" 103 (Aug. 1987).

*Primary Examiner*—Andres Kashnikow
*Assistant Examiner*—Kevin P. Weldon
*Attorney, Agent, or Firm*—Marshall, O'Toole, Gerstein, Murray & Bicknell

[57] ABSTRACT

A multifunction nozzle including a peripheral jet nozzle having a first end adapted to be connected to a liquid supply and a second end from which the jet is ejected. The liquid may be plain water or a mixture of water and a foam concentrate. The peripheral jet nozzle is adjustable between straight stream and fog positions. The multifunction nozzle further comprises a sleeve which is attached to and surrounds the peripheral jet nozzle, the sleeve being movable relative to the jet nozzle in the direction of the nozzle axis and the flow of the liquid. The sleeve is movable between a forwardly extended or foam position and a rearwardly retracted or inoperative position. When the sleeve is in the retracted position it is out of the path of the liquid jet and the nozzle may be used in either the straight stream or fog modes. When the sleeve is moved forwardly to the extended position and the peripheral jet nozzle is placed in the fog mode, the diverging liquid jet strikes the inner surface of the sleeve. An agitator is attached to the inner surface of the sleeve and causes the jet to break into fine particles. In the instance where the jet includes a mixture of water and foam concentrate, air is introduced into the mixture within the sleeve, and a dense foam is ejected. The nozzle may also be used in the straight stream mode when the sleeve is in the extended position.

11 Claims, 3 Drawing Sheets

MULTIFUNCTION NOZZLE

FIELD AND BACKGROUND OF THE INVENTION

This invention relates generally to nozzles for use with fire fighting equipment, and more particularly to a multifunction nozzle which has straight stream, fog and foam modes of operation.

The traditional method of extinguishing a fire has been to spray water on a burning object in order to wet it sufficiently to stop the burning. However, this method is not effective when the source of the fire is a flammable liquid-vapor such as gasoline or benzene; foam generators and nozzles have been developed which are very effective with such fires. Special-purpose nozzles have been developed to spray a layer of foam over the liquid, which prevents the flammable vapor from forming.

Very recently foam has also been used against fires in forests and wildlands, and it has been quite effective and desirable for a number of reasons. Water is usually in short supply in such areas, and foam can increase the effectiveness of a given quantity of water by a factor of 5 to 10 times because the total volume of foamed water is much greater than water alone because of the air in the foam bubbles. Some trees, such as pine and eucalyptus, are very oily, and whereas water tends to run off such trees, foam will stick to the trees and provide protection. Still further, the foam concentrate, or foam generating liquid, may include a water surface tension reducing agent which helps the foamed water to penetrate the combustible layer of material on the ground, or duff, and help to extinguish ground fires.

Prior art foam nozzles have been developed and used in forest fire situations but such nozzles have been special purpose or dedicated use nozzles. In other words, prior art foam nozzles cannot be also used as a fog nozzle or as a straight stream nozzle. Consequently it has been necessary to change nozzles when it is desired to switch from foam operation to straight stream or fog operation. When fighting a fire, especially in a forest, it is highly desirable to be able to switch, very quickly, from one mode of operation to another.

It is therefore a general object of the present invention to provide a multifunction nozzle which may be used in either foam, fog or straight stream modes of operation.

SUMMARY OF THE INVENTION

Apparatus in accordance with the present invention includes a peripheral jet nozzle having a first end adapted to be connected to a liquid supply and a second end from which the jet is ejected. The liquid may be plain water or a mixture of water and a foam concentrate. The nozzle is adjustable between straight stream and fog positions. The apparatus further comprises a sleeve which is attached to and surrounds the peripheral jet nozzle, the sleeve being movable relative to the nozzle in the direction of the nozzle axis and the flow of the liquid. The sleeve is movable between a forwardly extended or foam position and a rearwardly retracted or inoperative position. When the sleeve is in the retracted position it is out of the path of the liquid jet and the nozzle may be used in either the straight stream or fog modes. When the sleeve is moved forwardly to the extended position and the nozzle is placed in the fog mode, the diverging liquid jet strikes the inner surface of the sleeve. An agitator is attached to the inner surface of the sleeve and causes the jet to break into fine particles. In the instance where the jet includes a mixture of water and foam concentrate, air is introduced into the mixture within the sleeve, and a dense foam is ejected. The nozzle may also be used in the straight stream mode when the sleeve is in the extended position, the straight stream being of substantially smaller diameter, thus passing through the sleeve unmodified.

While the drawings depict one particular type of peripheral jet nozzle, it is understood that the foam aspirating sleeve herein described would produce foam if sized and fitted upon any peripheral jet nozzle that has a pattern which is adjustable from straight stream to fog positions.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
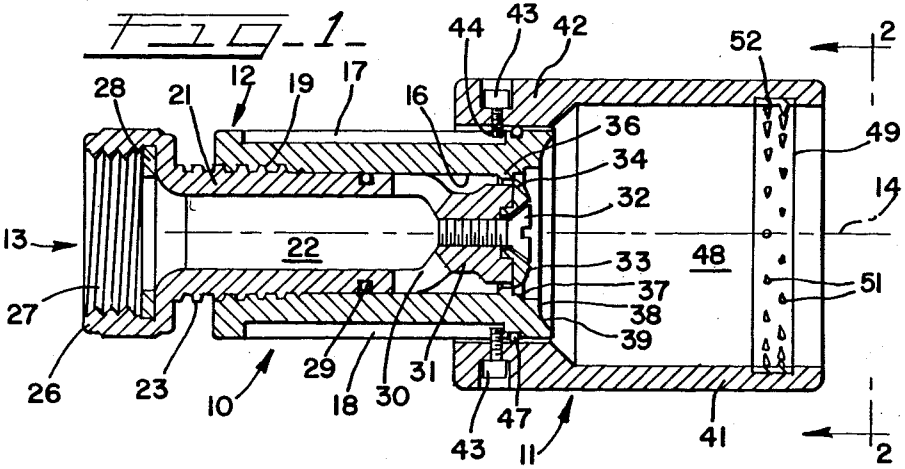
FIG. 1 is a side view in section of apparatus in accordance with the present invention.

With reference first to FIG. 1, a multifunction nozzle in accordance with this invention includes a peripheral jet nozzle 10 and a sleeve 11 which is movably fastened to the outer periphery of the nozzle 10. The nozzle 10 comprises a tubular barrel 12 and a plunger 13 which is movable within the barrel 12 parallel to the axis 14 of the nozzle 10.

With reference first to the barrel 12, it is a generally tubular member having a circular bore 16 formed through it. In the outer surface of the barrel 12 are formed two slots 17 and 18 which extend parallel to the axis 14 of the nozzle, the two slots 17 and 18 being, in the present example, spaced approximately 180° apart. The slots 17 and 18 stop short of the forward and rearward ends of the barrel. Internal threads 19 are formed on the inner periphery of the bore 16, the threads 19 being located adjacent the rearward (toward the left as seen in FIG. 1) end of the barrel 12.

The plunger 13 includes a tubular portion 21 having an internal flow passage 22 formed in it. On the outer periphery of the tubular portion 21 are formed threads 23 which mate with the threads 19 of the barrel 12. As illustrated in the drawings, the longitudinal position of the plunger 13 relative to the barrel 12 may be adjusted by turning the barrel 12 relative to the plunger so that the threads 19 and 23 cause the barrel to move axially relative to the plunger. At the rearward end of the plunger 13 is formed a coupler portion 26 which has internal threads 27. The coupler portion 26 is adapted to be connected, by means of the threads 27, to a source of fire extinguishing liquid. The liquid may, for example, comprise water or a mixture of water and a conventional concentrated foam liquid. A seal ring 28 is preferably provided within the coupler portion 26 and at the forward end of the threads 27 in order to form a sealed connection between the coupler portion and the source of liquid, and the outer surface of the coupler portion 26 may be knurled.

The tubular portion 21 of the plunger has a close sliding fit with the bore 16 of the barrel 12, and an O-ring 29 is mounted in a groove formed in the outer surface of the tubular portion 21 and forms a sealed connection with the bore 16. At the forward end of the plunger 13, the tubular portion 21 converges radially inwardly to form a tip 31. A plurality of openings 30 are formed through the wall of the tubular portion 21 immediately rearwardly of the tip 31, so that fluid flowing into the passage 22 may flow out of the passage through the openings 30 and around the outer surface of the tip 31. Fastened to the forward end of the tip 31 by a screw 32 is a cap 33 which is in the form of a disk having a central opening to receive the screw 32. The outer periphery of the cap 33 extends radially outwardly from the outer periphery of the tip 31 and forms a stop ledge 34.

At the forward end of the bore 16 of the barrel 12, a radially inwardly extending flange 36 is formed, and the cap 33 is forwardly of the flange 36. The dimensions are such that when the barrel is moved to the maximum extent in the forward direction, the forward surface of the flange 36 engages the stop surface 34 of the cap 33 and thus prevents liquid from flowing out of the nozzle 10. Forwardly of the flange 36 are a series of radially enlarged steps 37, 38 and 39; flow paths are formed between these steps and the outside diameter of the cap 33 when the barrel 12 is moved back from its maximum forward position.

The sleeve 11 is formed by a tubular wall 41 having a radially inwardly enlarged rearward portion 42. The interior surface of the portion 42 fits fairly snugly around the outer peripheral surface of the barrel 12 so that the sleeve 11 may be moved longitudinally, or parallel to the axis 14, relative to the barrel 12. Two screws 43 extend through radial holes formed through the portion 42, and the interior ends 44 of the screws 43 enter the slots 17 and 18. As previously mentioned, the two slots 17 and 18 stop short of the rearward and forward ends of the barrel, and consequently the screws 43 prevent the sleeve 41 from sliding off the ends of the barrel and also cause the sleeve 11 and the barrel 12 to rotate together. An O-ring 47 in an annular groove formed in the outer surface of the barrel 12 forms a sealed connection between the forward end of the barrel 12 and the rearward portion 42 of the sleeve 11 when the sleeve 11 is in its forward position.

Figure 2:
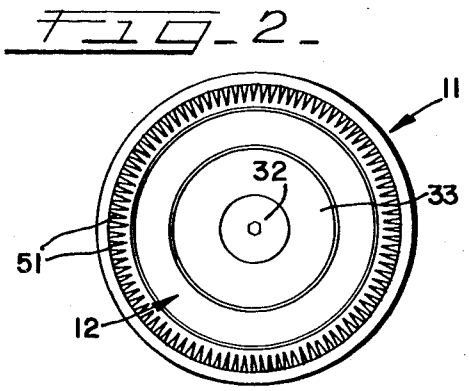
FIG. 2 is an end view of the apparatus taken on the line 2—2 of FIG. 1.

Forwardly of the rearward portion 42 of the sleeve 11, the cylindrical interior surface 48 of the sleeve 11 is radially enlarged. Agitator means is formed adjacent the forward end of the interior surface 48, and in the example illustrated in FIGS. 1 through 7, the agitator means is formed by an annular strip 49 which has a plurality of radially inwardly extending obstructions 51 (also see FIG. 2). An annular groove 52 is formed in the surface 48 and the strip 49 is fastened within the groove 52. With reference to FIGS. 1 and 7, the sleeve 11 is longitudinally movable on the barrel 12 between a rearward or retracted position shown in FIG. 7 wherein the screws 43 are adjacent the rearward ends of the slots 17 and 18 and the strip 49 is adjacent the forward end of the barrel 12, and an extended or forward position illustrated in FIG. 1 where the screws 43 are adjacent the forward ends of the slots 17 and 18 and the strip 49 is located substantially forwardly from the forward end of the nozzle 10.

Considering now the different modes of operation of the multifunction nozzle, assume that the coupler portion 26 is connected to a conventional source (not illustrated) of fluid. In this example, the fluid is formed by a mixture of water and a conventional foam concentrate such as that used in fighting forest fires. In the position of the parts shown in FIG. 1, the barrel 12 is screwed forwardly to its maximum extent and the flange 36 sealingly engages the stop surface 34 of the cap 33 and thus closes the nozzle 10.

Figure 3:
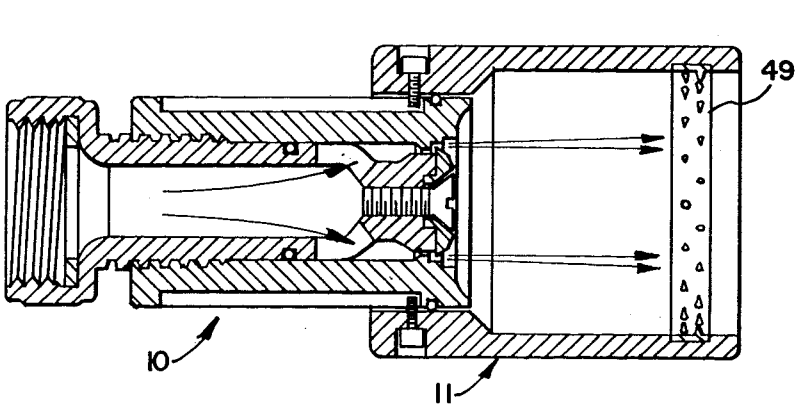

In the position of the parts illustrated in FIG. 3, the barrel 12 has been threaded rearwardly relative to the plunger a short distance so that the cap 33 is spaced forwardly from the flange 36. The mixture flows in the path indicated by the arrows in FIG. 3 and forms an essentially straight stream of the mixture. It should be noted from FIG. 3 that even though the sleeve 41 is in its extended or forward position, the mixture does not strike the sleeve 11.

Figure 4:
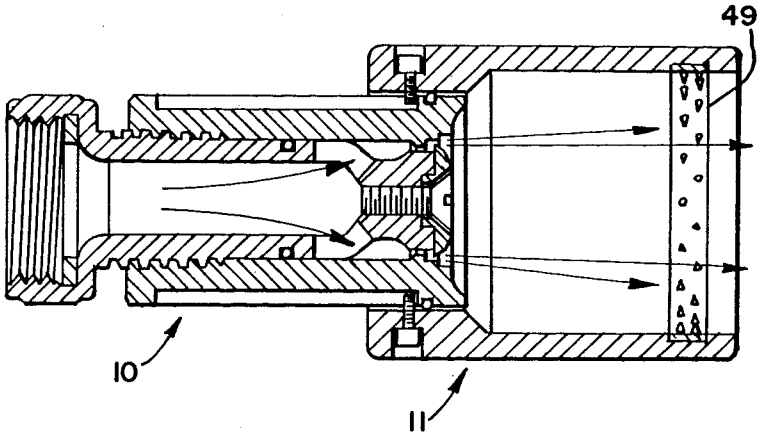
FIGS. 3–7 are views similar to FIG. 1 but illustrating different positions of the parts and different modes of operation.

In the position of the parts illustrated in FIG. 4, the barrel 12 has been threaded a short distance rearwardly relative to the position illustrated in FIG. 3. The mixture follows the paths indicated by the arrows in FIG. 4.

Figure 5:
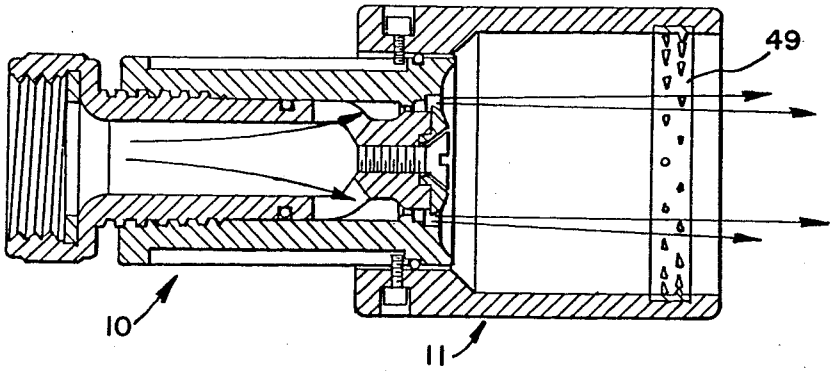

In the position illustrated in FIG. 5, the barrel 12 has been threaded an additional distance rearwardly. In this position the jet or stream again forms a straight stream which does not engage the sleeve 11.

It will be apparent therefore that in the positions of the parts shown in FIGS. 1 to 5, the jet nozzle 10 operates in its normal manner even though the sleeve 11 is in its forward position.

Figure 6:
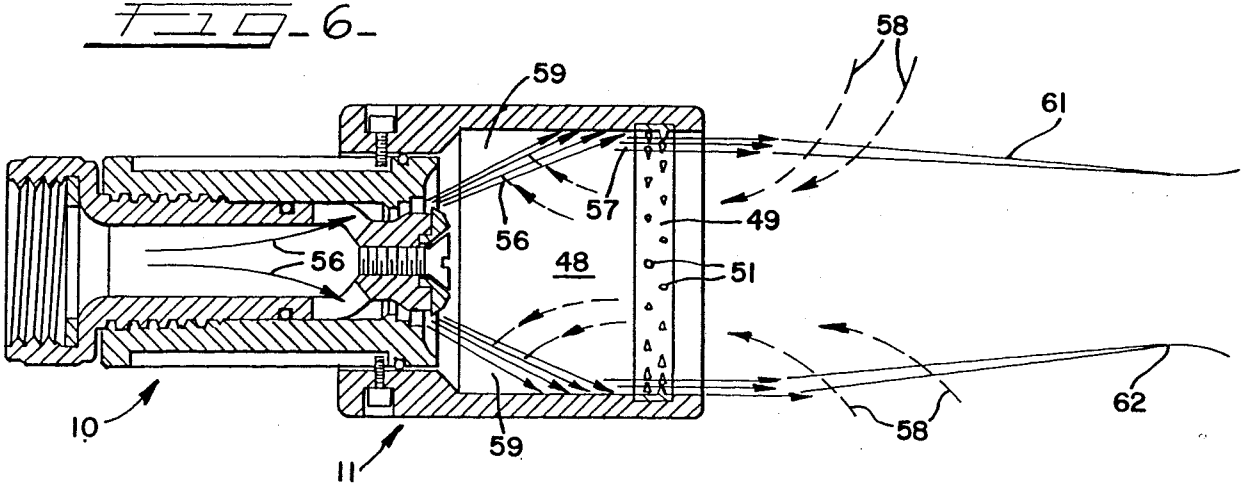
Figure 7:
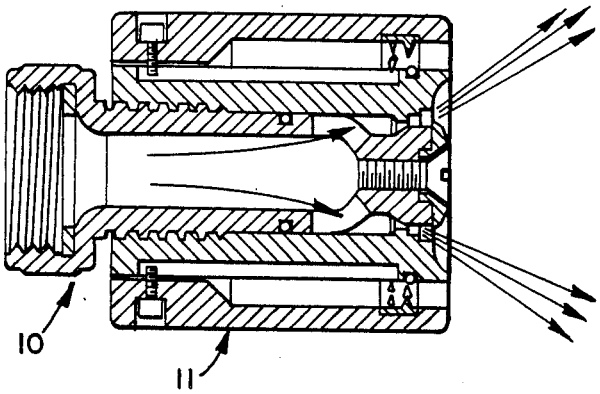

With reference now to FIG. 6 which illustrates the foam mode of operation, the outer barrel 12 has been threaded rearwardly to create a conically divergent flow. The liquid mixture follows the paths illustrated by the arrows 56 and flows through the passage formed between the tip 31 and the steps 37, 38 and 39. The mixture has a large angle of divergence and strikes the interior surface 48 of the sleeve 11 rearwardly of the strip 49, and then the mixture flows substantially longitudinally along the inner surface 48 and through the obstructions 51 of the strip 49.

As previously mentioned, the barrel 12 and the plunger 13 form a peripheral jet nozzle, and consequently the mixture flowing forwardly from the tip 31 is in the form of an annular cone portion 56 and then a cylindrical portion 57. The rapid movement of the liquid particles in the cone and the longitudinal portions 56 and 57 draws air from the interior of the sleeve 11 into the stream of the mixture and thereby creates a very low pressure central area within the interior of the cylindrical portion 57. The air from outside the sleeve flows into this low pressure area along the paths indicated by the dashed lines 58 in FIG. 6. Radially outwardly from the cone portion 56 of the liquid stream is formed an annular sealed space 59 formed between the cone portion 56, the sleeve 11, the seal 47 and the forward end of the barrel 12, and a partial vacuum is formed in the space 59 because the movement of the liquid entrains or draws the air out of the space 59. The air entering the central area of the annular stream of liquid attempts to flow into the annular sealed space 59 and through the conical portion 56 of the stream.

It will be apparent therefore that the air passes twice through the annular streams of liquid, first as the air 58 flows through the longitudinal portion 57 of the liquid just forwardly of the sleeve 11 and secondly as the air flows into the conical portion 56 of the liquid as it attempts to enter the annular space 59. As the entrained air strikes the liquid, bubbles are formed. Additional foaming and mixing occurs as the liquid strikes the surface 48 of the sleeve 11 and then flows through the obstructions 51 of the strip 49. These particles mix with the air flowing through the stream and create a dense foam in the stream portion 61 which is forwardly of the barrel 11. Air also mixes with the conical portion of the liquid before it meets the obstructions 51. As illustrated in FIG. 6, the partial vacuum within the annular stream portion 61 causes the stream to converge slightly to the reduced diameter portion 62 of the stream, and then forwardly of the portion 62 the stream spreads out.

FIG. 7 illustrates the fog mode of operation wherein the barrel and the plunger have the relative positions illustrated in FIG. 6 but the sleeve 11 has been moved to its retracted position. In the position illustrated in FIG. 7 therefore, the mixture leaving the nozzle 10 will spray or fan outwardly in a wide angle of divergence but since the sleeve 11 is retracted, the stream will not strike the sleeve. The jet nozzle 10 therefore operates in its normal manner to produce a fog.

Figure 8:
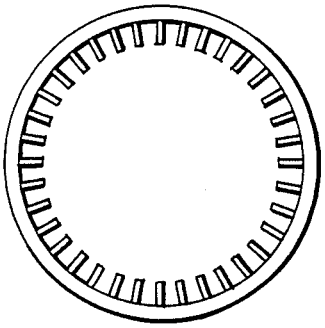
FIG. 8 is an end view of an alternative sleeve construction.
Figure 10:
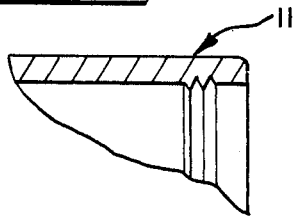
FIG. 10 is a fragmentary sectional view of another alternative sleeve construction.
Figure 9:
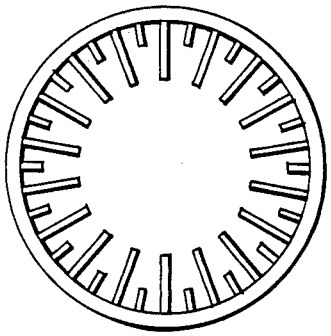
FIG. 9 is an end view showing still another alternative sleeve construction.

The agitating means may take various forms. Instead of the strip 49 and obstructions 51, the interior surface of the sleeve may be formed with integral heavily roughened or grooved or projections on the surface (see FIG. 10). Further, instead of the relatively short pointed obstructions 51 as illustrated in FIGS. 1 through 6, the obstructions may be rectangular and may be extended radially inwardly a uniform distance as shown in FIG. 8 or at alternately shorter and longer distances as illustrated in FIG. 9. The radial length of the obstructions illustrated in FIGS. 8 and 9 should not be so long that they extend across the path of the straight stream when the sleeve is in the extended position. It is desirable that any obstruction or agitation method be self-cleaning in the event debris is contained in the liquid stream. The obstructions may be slanted forwardly to this effect.

It will be apparent from the foregoing that an improved multifunction nozzle has been provided. The peripheral jet nozzle 10 may be employed in the straight stream modes or, with the sleeve 11 in the fully retracted position, in the fog mode. To employ the apparatus in the foam mode, the sleeve 11 is moved to its forward position and the nozzle 10 is adjusted to what would normally be a widely diverging stream such as that used in the fog operation. When the sleeve 11 is in the forward position, the apparatus may also be used in the straight stream mode but not in the fog mode. Thus, a fire fighter has three modes of operation available to him without changing nozzles, and the adjustments are relatively simple and quick. Since the sleeve 11 is keyed, by the screws 43, to the barrel 12, the barrel may be rotated relative to the plunger simply by applying a turning force to the sleeve.

What is claimed is:

1. A multifunction nozzle, comprising:

(a) a peripheral jet nozzle including barrel means and plunger means connected together for relative movement, said plunger means being adapted to receive a flow of liquid and said barrel means being movable relative to said plunger means to produce a substantially straight stream exit flow or a conically divergent exit flow of the liquid;

(b) a sleeve extending around said barrel and plunger means and being movable relative to said barrel means;

(c) said peripheral jet nozzle being operable to produce a conically divergent flow and said sleeve being movable into the exit flow of the liquid and the liquid being deflected forwardly by said sleeve, whereby the flow of said liquid causes air adjacent to it to be moved along with it, thereby creating a partial vacuum within said sleeve; and (d) said partial vacuum within said sleeve inducing air from outside said sleeve to flow into said sleeve through said deflected flow of liquid;

(e) whereby a liquid containing a foaming agent creates a foam from said flows, and further including agitating means on said sleeve and located in the flow of the liquid.

2. A multifunction nozzle as set forth in claim 1, wherein an annular void is formed between said conically divergent flow from said peripheral jet nozzle and said sleeve, and said flow between said nozzle and said sleeve is free flowing before striking said sleeve.

3. A multifunction nozzle, comprising:

(a) a peripheral jet nozzle including a barrel and a plunger, said barrel having a bore formed therethrough and said plunger being movably mounted within said bore, said nozzle having a rearward end thereof adapted to be coupled during operation thereof to a source of fire extinguishing liquid and a forward end thereof adapted for the exit flow of the liquid, said plunger and said barrel being relatively movable between a straight stream position wherein the exit flow is generally straight and a fog position wherein the exit flow is generally conical;

(b) a sleeve movably attached to and surrounding said jet nozzle and movable relative to said jet nozzle between retracted and extended positions, said sleeve when in said extended position extending forwardly from said forward end of said nozzle and around said exit flow and being in the path of said generally conical exit flow and out of the path of said straight exit flow, said sleeve in said extended position producing a forwardly deflected flow from said conical exit flow, and said sleeve when in said retracted position being rearward of said extended position and being out of the path of said straight and conical exit flow, and further including agitating means on said sleeve and in said path of said forwardly deflected flow for producing foam from a liquid containing a foaming agent.

4. A multifunction nozzle as set forth in claim 3, wherein said agitating means includes a plurality of obstructions.

5. A multifunction nozzle as set forth in claim 4, wherein said obstructions are substantially pointed.

6. A multifunction nozzle as set forth in claim 4, wherein said obstructions are substantially rectangular.

7. A multifunction nozzle, comprising:

(a) a peripheral jet nozzle including a barrel and a plunger, said barrel having a bore formed therethrough and said plunger being movably mounted within said bore, said nozzle having a rearward end thereof adapted to be coupled during operation thereof to a source of fire extinguishing liquid and a forward end thereof adapted for the exit flow of the liquid, said plunger and said barrel being relatively movable between a straight stream position wherein the exit flow is generally straight and a fog position wherein the exit flow is generally conical;

(b) a sleeve movably attached to and surrounding said jet nozzle and movable relative to said jet nozzle between retracted and extended positions, said sleeve when in said extended position extending forwardly from said forward end of said nozzle and around said exit flow and being in the path of said generally conical exit flow and out of the path of said straight exit flow, said sleeve in said extended position producing a forwardly deflected flow from said conical exit flow, and said sleeve when in said retracted position being rearward of said extended position and being out of the path of said straight and conical exit flow, wherein when said jet nozzle is in said fog position and said sleeve is in said extended position, said conical exit flow strikes said sleeve and an enclosed space is formed between said forward end of said jet nozzle, said sleeve and said conical exit flow.

8. A multifunction nozzle as set forth in claim 3, wherein said agitating means on said sleeve comprises at least one circumferential groove.

9. A multifunction nozzle, comprising:

(a) a peripheral jet nozzle adapted to receive a flow of liquid and being operable to produce a substantially straight stream exit flow or a conically divergent exit flow of the liquid;

(b) a sleeve extending around said nozzle and being movable relative to said nozzle;

(c) said peripheral jet nozzle being operable to produce a conically divergent flow and said sleeve being movable in the exit flow of the liquid and the liquid being deflected forwardly by said sleeve, whereby the flow of said liquid causes air adjacent to it to be moved along with it, thereby creating a partial vacuum within said sleeve; and (d) said partial vacuum within said sleeve inducing air from outside said sleeve to flow into said sleeve through said deflected flow of liquid;

(e) whereby a liquid containing a foaming agent creates a foam from said conically divergent flow, and further including agitating means on said sleeve and located in the flow of the liquid.

10. A multifunction nozzle as set forth in claim 9, wherein an annular void is formed between said conically divergent flow from said peripheral jet nozzle and said sleeve, and said flow between said nozzle and said sleeve is free flowing before striking said sleeve.

11. A multifunction nozzle, comprising:

(a) a peripheral jet nozzle adapted to receive a flow of liquid and being operable to produce a substantially straight stream exit flow or a conically divergent exit flow of the liquid;

(b) a sleeve extending around said nozzle and being movable relative to said nozzle;

(c) said peripheral jet nozzle being operable to produce a conically divergent flow and said sleeve being movable in the exit flow of the liquid and the liquid being deflected forwardly by said sleeve, whereby the flow of said liquid causes air adjacent to it to be moved along with it, thereby creating a partial vacuum within said sleeve; and (d) said partial vacuum within said sleeve inducing air from outside said sleeve to flow into said sleeve through said deflected flow of liquid;

(e) whereby a liquid containing a foaming agent creates a foam from said conically divergent flow, wherein said peripheral jet nozzle includes barrel means and plunger means, said sleeve being movably attached to said barrel means.

* * * * *